US009207634B2

(12) United States Patent
Imai

(10) Patent No.: US 9,207,634 B2
(45) Date of Patent: Dec. 8, 2015

(54) IMAGE FORMATION APPARATUS THAT HAS TEMPERATURE SENSOR FOR DETECTING TEMPERATURE THEREIN

(71) Applicant: Oki Data Corporation, Tokyo (JP)

(72) Inventor: Manabu Imai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/474,403

(22) Filed: Sep. 2, 2014

(65) Prior Publication Data

US 2015/0063859 A1 Mar. 5, 2015

(30) Foreign Application Priority Data

Sep. 2, 2013 (JP) ..... 2013-181486

(51) Int. Cl.

*G03G 15/16* (2006.01)
*G03G 21/20* (2006.01)
*G03G 15/00* (2006.01)

(52) U.S. Cl.

CPC ..... *G03G 21/206* (2013.01); *G03G 15/1665* (2013.01); *G03G 15/75* (2013.01); *G03G 2215/0634* (2013.01)

(58) Field of Classification Search

CPC ... G03G 15/1665; G03G 15/15; G03G 15/75; G03G 2215/0634; G03G 21/20; G03G 21/206
See application file for complete search history.

(56) References Cited

U.S. PATENT DOCUMENTS

| | | | | |
|---|---|---|---|---|
| 4,154,521 | A * | 5/1979 | Tanaka | 399/93 |
| 4,720,727 | A * | 1/1988 | Yoshida | 399/93 |
| 5,073,796 | A * | 12/1991 | Suzuki et al. | 399/93 |
| 6,266,498 | B1 * | 7/2001 | Oda et al. | 399/92 |
| 2003/0002881 | A1 * | 1/2003 | Hirose et al. | 399/44 |
| 2009/0202267 | A1 * | 8/2009 | Nakamura et al. | 399/92 |
| 2011/0026964 | A1 * | 2/2011 | Yasumoto | 399/94 |
| 2011/0299898 | A1 * | 12/2011 | Ito et al. | 399/328 |
| 2015/0037061 | A1 * | 2/2015 | Uchida et al. | 399/92 |

FOREIGN PATENT DOCUMENTS

| | | | |
|---|---|---|---|
| JP | 2000-200016 | A | 7/2000 |
| JP | 2004-212968 | A | 7/2004 |
| JP | 2004-325762 | A | 11/2004 |
| JP | 2005-077499 | A | 3/2005 |

* cited by examiner

*Primary Examiner* — Clayton E Laballe
*Assistant Examiner* — Ruifeng Pu
(74) *Attorney, Agent, or Firm* — Marvin A. Motsenbocker; MOTS Law, PLLC

(57) ABSTRACT

An image formation apparatus includes: a developer image carrier configured to carry a developer image; a transfer unit provided in contact with the developer image carrier, and configured to transfer the developer image onto a medium which is conveyed along a medium conveyance path and passes through a contact between the developer image carrier and the transfer unit; a blower provided on one of upstream and downstream sides, in a medium conveyance direction, of the contact, and configured to cool the surface temperature of the developer image carrier; and a temperature sensor provided on the other of upstream and downstream sides, in the medium conveyance direction, of the contact, and configured to sense an ambient temperature around the developer image carrier.

20 Claims, 8 Drawing Sheets

IMAGE FORMATION APPARATUS THAT HAS TEMPERATURE SENSOR FOR DETECTING TEMPERATURE THEREIN

CROSS REFERENCE TO RELATED APPLICATIONS

This application claims priority based on 35 USC 119 from prior Japanese Patent Application No. 2013-181486 filed on Sep. 2, 2013, entitled "IMAGE FORMATION APPARATUS", the entire contents of which are incorporated herein by reference.

BACKGROUND OF THE INVENTION

1. Field of the Invention

This disclosure relates to an image formation apparatus and can be applied to an image formation apparatus including a developer image carrier for carrying a developer image, for example.

2. Description of Related Art

An image formation apparatus such as a printer, a copying machine, or a facsimile device has a photoreceptor drum, as a developer image carrier, which carries a developer image when a developer is deposited on an electrostatic latent image formed by exposure to light. The developer image on the photoreceptor drum is transferred to a medium (a sheet of paper, for example) conveyed by a conveyor belt. The image on the medium is fixed by being pressed/heated by a fixing device, and thus the image is formed on the medium.

Conventionally, when continuous printing or the like is performed in an image formation apparatus, for example, a temperature within the image formation apparatus rises, and the surface temperature of a photoreceptor drum rises accordingly. In such a case, developer characteristics degrade, which may result in degradation of the print quality.

Patent Literature 1 (Japanese Patent Application Publication No. 2004-212968) describes a technique for improving the print quality by sensing the surface temperature of a photoreceptor drum and controlling image formation processing based on the sensed temperature. Particularly, the technique described in Patent Literature 1 senses the temperature of a conveyor belt abutting on the photoreceptor drum and controls the image formation processing by using the sensed temperature as the surface temperature of the photoreceptor drum.

SUMMARY OF THE INVENTION

However, the technique described in the above-mentioned Patent Literature 1 senses the surface temperature of the photoreceptor drum via the conveyor belt. Thus, if ventilation is performed to cool the photoreceptor drum, the conveyor belt itself is cooled, which may cause a problem that the surface temperature of the photoreceptor drum cannot be sensed accurately.

In addition, while many image formation apparatuses such as color printers and the like have a conveyor belt, many image formation apparatuses such as monochrome printers have no conveyor belt. Thus, an image formation apparatus without a conveyor belt may have a problem in that it is difficult to sense the temperature of a photoreceptor drum via a conveyor belt where there is none.

It is an object of an embodiment of the invention is to provide an image formation apparatus capable of accurately sensing the temperature of a developer image carrier, to improve the print quality.

An aspect of the invention is an image formation apparatus that includes: a developer image carrier configured to carry a developer image; a transfer unit provided in contact with the developer image carrier, and configured to transfer the developer image onto a medium which is conveyed along a medium conveyance path and passes through a contact between the developer image carrier and the transfer unit; a blower provided on one of upstream and downstream sides, in a medium conveyance direction, of the contact, and configured to cool the surface temperature of the developer image carrier; and a temperature sensor provided on the other of the upstream and downstream sides, in the medium conveyance direction, of the contact, and configured to sense an ambient temperature around the developer image carrier.

According to the above aspect of the invention, the temperature of a developer image carrier can be accurately sensed to improve the print quality.

DETAILED DESCRIPTION OF EMBODIMENTS

Figure 1:
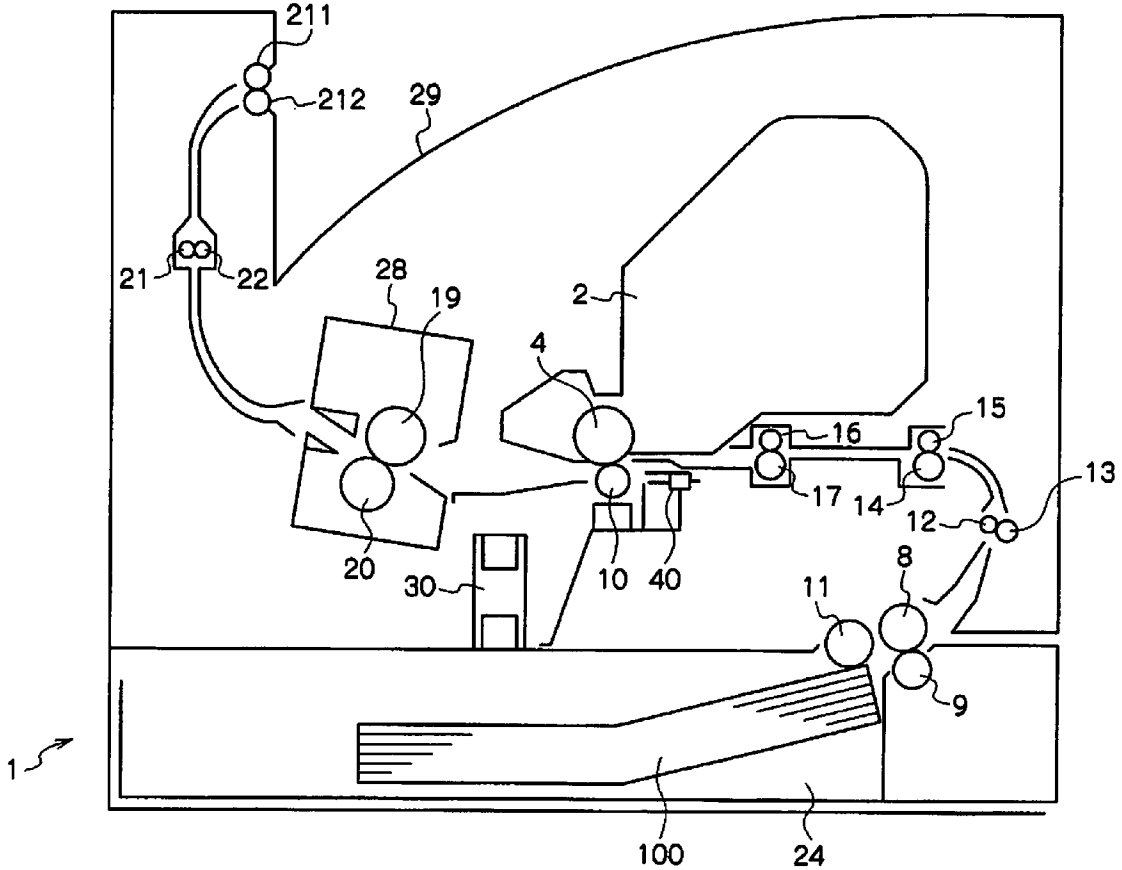
FIG. 1 is a sectional perspective view illustrating an internal configuration of the housing interior of an image formation apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(A) First Embodiment

In the following, a first embodiment of an image formation apparatus of the invention is described in detail with reference to the drawings.

In the first embodiment, a case of applying the invention to an image formation apparatus which adopts an electrophotographic scheme is illustrated by an example and described.

(A-1) Configuration of the First Embodiment

FIG. 1 is a perspective sectional view illustrating an internal configuration of the housing interior of image formation apparatus 1 according to the first embodiment.

In FIG. 1, image formation apparatus 1 according to the first embodiment has image formation unit 2, sheet cassette 24, photoreceptor drum 4, transfer roller 10, paper feed roller 11, separation rollers 8 and 9, first resist roller 12, first pressure roller 13, second resist roller 14, second pressure roller 15, conveyance rollers 16 and 17, fixing unit 19, fixing backup roller 20, fixing unit 28, ejection rollers 21 and 22, ejection rollers 211 and 212, blower 30, and temperature sensor 40.

Sheet cassette 24 is a cassette configured to house sheets of paper as a medium.

Paper feed roller 11 is configured to feed out a sheet of paper positioned at the top of the sheets housed in sheet cassette 24 and feed the sheet to separation rollers 8 and 9.

Separation rollers 8 and 9 are configured to separate sheets fed from paper feed roller 11 one by one and feed them to a sheet conveyance path.

First resist roller 12 and first pressure roller 13 are configured to feed sheets, which are separated one by one by separation rollers 8 and 9, to second resist roller 14 and second pressure roller 15 via the sheet conveyance path.

Second resist roller 14 and second pressure roller 15 are configured to feed the sheets from first resist roller 12 and first pressure roller 13 to conveyance rollers 16 and 17 via the sheet conveyance path.

Conveyance rollers 16 and 17 are configured to feed the sheets from second resist roller 14 and second pressure roller 15 to a nip part 130 (see FIG. 2) where photoreceptor drum 4 of image formation unit 2 is in contact with transfer roller 10.

Image formation unit 2 includes photoreceptor drum 4 as a component. Image formation unit 2 is configured to form an electrostatic latent image on the surface of photoreceptor drum 4, deposit a developer on the electrostatic latent image to create a developer image, and transfer the developer image onto a sheet of paper conveyed from conveyance rollers 16 and 17, thereby forming an image.

Photoreceptor drum 4 is configured to carry the developer image created by depositing the developer on the electrostatic latent image formed by exposure to light. Photoreceptor drum 4 is provided to face transfer roller 10, and configured to rotate while being in contact with transfer roller 10. The sheet conveyed by conveyance rollers 16 and 17 is fed to nip part 130 (see FIG. 2) between photoreceptor drum 4 and transfer roller 10, and the developer image carried by the surface of photoreceptor drum 4 is transferred to the sheet. Note that photoreceptor drum 4 serves as a developer image carrier.

In addition, photoreceptor drum 4 is replaceable. A variety of methods for replacing photoreceptor drum 4 are available. For example, photoreceptor drum 4 may be integrally formed with image formation unit 2, and thus be replaced together with image formation unit 2 when it is replaced. Even when photoreceptor drum 4 is replaced, photoreceptor drum 4 after being replaced may be in contact with transfer roller 10 to form nip part 130 (see FIG. 2).

Figure 2:
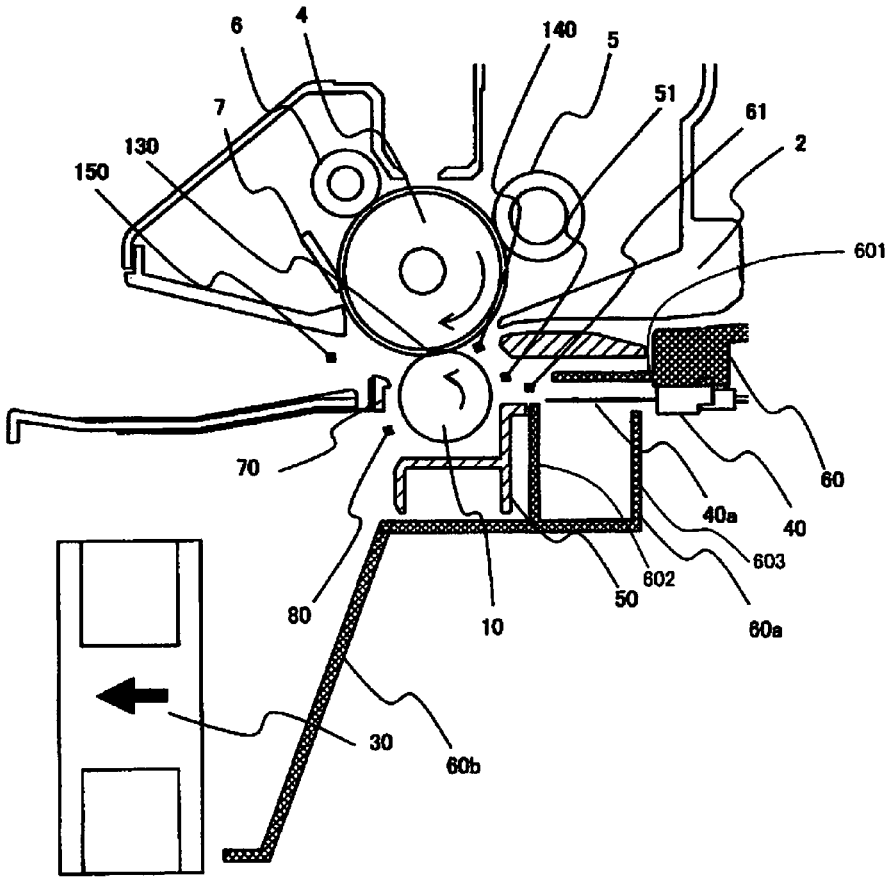
FIG. 2 is a configuration diagram illustrating a detailed configuration of a periphery of a temperature sensor in the image formation apparatus according to the first embodiment.

Transfer roller 10 is provided to face photoreceptor drum 4 of image formation unit 2, and is configured to transfer the developer image on the surface of photoreceptor drum 4 to the sheet between transfer roller 10 and photoreceptor drum 4 in nip part 130 (see FIG. 2). Note that transfer roller 10 is a transfer unit.

Fixing roller 19 and fixing backup roller 20 are configured to feed the sheet from photoreceptor drum 4 and transfer roller 10 to the interior of fixing unit 28 to cause fixing unit 28 to perform fixing.

Fixing unit 28 has a heating element such as a halogen lamp and the like and is configured to fix the developer on the sheet having the transferred image through heating and pressing.

Ejection rollers 21 and 22 are configured to feed the sheet on which the developer is fixed by fixing unit 28 to ejection rollers 211 and 212.

Ejection rollers 211 and 212 are configured to eject the sheet from ejection rollers 21 and 22 to sheet load surface 29.

Blower 30 is a fan configured to prevent elevation of the surface temperature of photoreceptor drum 4 as a developer image carrier. Blower 30 is arranged on the downstream side of a paper conveyance direction with nip part 130 (see FIG. 2), where photoreceptor drum 4 and transfer roller 10 are in contact, as a boundary. Blower 30 prevents temperature elevation within image formation apparatus 1 to prevent elevation of the surface temperature of photoreceptor drum 4, by exhausting air inside the apparatus to the outside air on the downstream side in the sheet conveyance direction with nip part 130 (see FIG. 2), where photoreceptor drum 4 and transfer roller 10 are in contact, as a boundary. Note that the position to arrange blower 30 at is not specifically limited so far as at the position, the air on the downstream side in the sheet conveyance direction with nip part 130 (see FIG. 2), where photoreceptor drum 4 and transfer roller 10 are in contact, as a boundary, can be exhausted.

Temperature sensor 40 is configured to sense an ambient temperature around photoreceptor drum 4. Specifically, the ambient temperature of photoreceptor drum 4 varies due to heat released by photoreceptor drum 4, the surface temperature of which is increased. Temperature sensor 40 senses the ambient temperature around photoreceptor drum 4 which releases heat from the surface thereof. For temperature sensor 40, a non-contact type thermistor or a non-contact type temperature sensor can be used, for example.

In addition, temperature sensor 40 is arranged on the upstream side in the sheet conveyance direction with nip part 130 (see FIG. 2) between photoreceptor drum 4 and transfer roller 10 as a boundary. Note that the position to arrange temperature sensor 40 at is not specifically limited so far as at the position, the ambient temperature of photoreceptor drum 4 can be sensed.

Note that with blower 30 as described above exhausting air on the downstream side in the sheet conveyance direction with nip part 130 (see FIG. 2) between photoreceptor drum 4 and transfer roller 10 as a boundary, the air on the upstream side in the sheet conveyance direction with nip part 30 as a boundary can also flow to temperature sensor 40, albeit only slightly. Consequently, the precision in sensing the ambient temperature around photoreceptor drum 4 by temperature sensor 40 can be improved.

In this embodiment, airflow from the upstream side in the sheet conveyance direction with nip part 130 as a boundary flowing to blower 30 is formed to move the air around photoreceptor drum 40 to a neighborhood of temperature sensor 40. However, even in an embodiment in which the airflow as described above is not formed to move the air around photoreceptor drum 4 to temperature sensor 40, the ambient temperature around photoreceptor drum 4 can be adequately sensed. Specifically, even if the airflow as described above is not formed, sensing of the ambient temperature around photoreceptor drum 4 can be achieved by the arrangement of temperature sensor 40 in a position where the ambient temperature around photoreceptor drum 4 can be sensed.

In addition, in order to control the driving of photoreceptor drum 4, temperature sensor 40 provides information on sensed temperatures to a controller.

FIG. 2 is a configuration diagram illustrating a detailed configuration of a periphery of temperature sensor 40 in image formation apparatus 1 according to the first embodiment.

In FIG. 2, a configuration of a periphery of temperature sensor 40 of image formation apparatus 1 has photoreceptor drum 4, development roller 5, charging roller 6, cleaning blade 7, transfer roller 10, blower 30, temperature sensor 40, transfer frame 50, sheet conveyance direction upstream-side guide frame 60, sheet conveyance direction upstream-side frame 60*a*, sheet conveyance direction downstream-side guide ventilation wall 60*b*, and sheet conveyance direction downstream-side guide frame 70.

Charging roller 6, development roller 5, and cleaning blade 7 are provided inside image formation unit 2. Charging roller 6 is configured to uniformly charge a surface of photoreceptor drum 4. Development roller 5 is provided to photoreceptor drum 4, which rotates in the arrow direction of FIG. 2, on the upstream side of nip part 130 between photoreceptor drum. 4 and transfer roller 10, and is configured to deposit a developer on an electrostatic latent image formed on the surface of photoreceptor drum 4. Specifically, abutting on photoreceptor drum 4, development roller 5 is configured to transfer to photoreceptor drum 4 a developer housed in a developer housing of image formation unit 2, by rotating following photoreceptor drum 4. Cleaning blade 7 is provided to photoreceptor drum 4, which rotates in the arrow direction of FIG. 2, on the downstream side of nip part 130, and is configured to remove any developer remaining on photoreceptor drum 4 after a developer image is transferred.

In FIG. 2, blower 30 is configured to form an airflow flowing from the downstream side of sheet conveyance with nip part 130 between photoreceptor drum 4 and transfer roller 10 as a boundary to the direction of blower 30. Blower 30 exhausts air in image formation apparatus 1 to the outside by a fan. Consequently, by blower 30 exhausting to the outside the air on the downstream side in the sheet conveyance direction with nip part 130 where photoreceptor drum 4 and transfer roller 10 are in contact, as a boundary, a temperature elevation in image formation apparatus 1 can be prevented and elevation of the surface temperature of photoreceptor drum 40 can be prevented.

In addition, by blower 30 exhausting to the outside the air on the downstream side in the sheet conveyance direction with nip part 130 between photoreceptor drum 4 and transfer roller 10 as a boundary, the air on the upstream side with nip part 130 as a boundary may also generate supplementary airflow toward blower 30. Since this can move air accumulated around photoreceptor drum 4 to temperature sensor 40, the precision of the temperature sensing by temperature sensor 40 can be improved.

For example, from the air on the upstream side with nip part 130 as a boundary, the supplementary airflow to blower 30 can be made by passing the air through a vent passage. The vent passage includes sheet conveyance direction space upstream-side 140, transfer frame opening 51 formed between transfer roller 10 and transfer frame 50 retaining transfer roller 10, and downstream-side air duct 80 between a lower surface part of sheet conveyance downstream guide 70 and transfer roller 10.

Sheet conveyance direction upstream-side guide frame 60 is configured to guide a sheet conveyed from conveyance rollers 16 and 17 (see FIG. 1). Sheet conveyance direction upstream-side guide frame 60 has a flat upper surface to guide sheets to be conveyed. In addition, temperature sensor 40 is retained on a lower surface part of sheet conveyance direction upstream-side guide frame 60. Furthermore, partition member 601 is arranged along a horizontal direction below sheet conveyance direction upstream-side guide frame 60.

In sheet conveyance direction upstream-side frame 60*a*, partition members 602 and 603 are provided in a direction perpendicular to the bottom which is arranged along the horizontal direction.

Now, a plate and the like to be arranged along the longitudinal direction of photoreceptor drum 4 can be used for partition members 601, 602, and 603, which are provided to surround temperature sensor 40 provided on the lower surface part of sheet conveyance direction upstream-side guide frame 60. Thus, partition members 601, 602 and 603 function as a block unit which blocks air other than the ambient temperature around photoreceptor drum 4. In addition, a tip of partition member 601 arranged along the horizontal direction is out of contact with a tip of partition member 602 arranged in a vertical direction, and thermosensitive opening 61 is formed so that thermosensitive part 40*a* of temperature sensor 40 can sense the ambient temperature of photoreceptor drum 4.

Thermosensitive part 40*a* of temperature sensor 40 is provided to be positioned close to transfer frame opening 51 to sense the ambient temperature of photoreceptor drum 4. Specifically, thermosensitive opening 61 is formed in the neighborhood of transfer frame opening 51, so that thermosensitive part 40*a* of temperature sensor 40 can sense the ambient temperature of transfer frame opening 51 through thermosensitive opening 61.

Sheet conveyance direction downstream-side guide ventilation wall 60*b* is provided at an angle to a direction near blower 30 from an end of sheet conveyance direction upstream-side frame 60*a*, and is configured to guide air to the neighborhood of blower 30.

Sheet conveyance direction downstream-side guide frame 70 is configured to guide the conveyance of a sheet to be ejected from nip part 130 between photoreceptor drum 4 and transfer roller 10.

Figure 3:
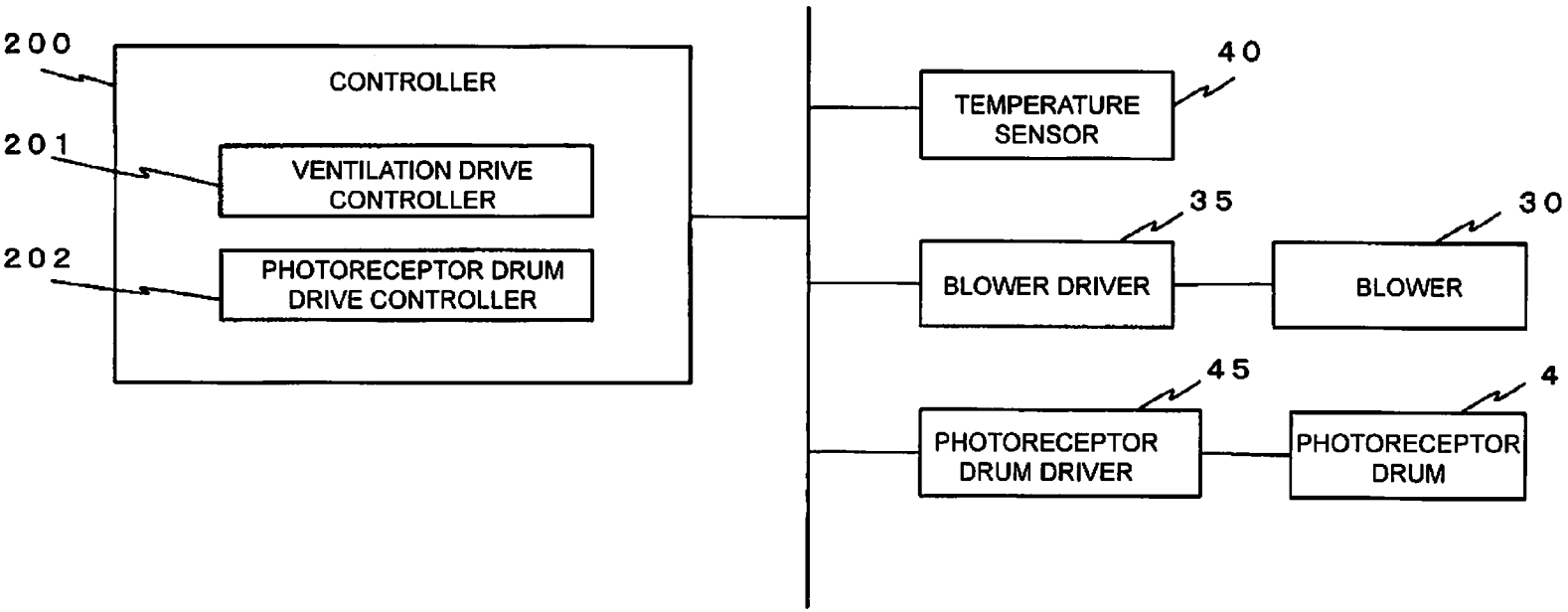
FIG. 3 is a block diagram illustrating a configuration of the drive and control of a photoreceptor drum in the image formation apparatus according to the first embodiment.

FIG. 3 is a block diagram illustrating the configuration of the drive and control of photoreceptor drum 4 in image formation apparatus 1 according to the first embodiment.

In FIG. 3, controller 200, as a control system in image formation apparatus 1, is connected with temperature sensor 40, blower driver 35 for driving blower 30, and photoreceptor drum driver 45 for driving photoreceptor drum 4.

Controller 200 is configured to manage a processing function in image formation apparatus 1. For example, controller 200 has a CPU, a ROM, a RAM, an EEPROM, an input/output interface unit and the like. Controller 200 is configured to achieve the function of image formation apparatus 1 by, for example, causing the CPU to perform a processing program stored in the ROM. Note that the processing program can be installed by downloading, and performs functionally with reference to FIG. 3. Controller 200 is configured to be contained in a control unit that houses blower drive controller 201 and photoreceptor drum drive controller 202, with controller 200 thus providing the functionality of controllers 201 and 202.

In order to drive the fan of blower 30 during an image formation operation, upon receipt of a print order, blower drive controller 201 is configured to instruct blower driver 35 to start driving and instruct blower driver 35 to finish driving when printing ends. Note that blower drive controller 201 may be configured to drive the fan of blower 30 all the time during the image formation operation, or to control the driving of the fan of blower 30 when an internal temperature of image formation apparatus 1 is increased, such as when a continuous printing is ordered or when image formation apparatus 1 is turned ON for a long time.

Photoreceptor drum drive controller 202 is configured to acquire a sensed temperature from temperature sensor 40, compare the sensed temperature with one or more threshold(s), and control the rotation operation of photoreceptor drum 4 based on a result of the comparison.

(A-2) Operation of the first embodiment

In the following, an operation of image formation apparatus 1 according to the first embodiment is described.

First, an operation of image formation processing in image formation apparatus 1 as illustrated in FIG. 1 is described.

When a print order is given in image formation apparatus 1, top sheet 100 loaded in sheet cassette 24 is fed out by paper feed roller 11, and sheets are conveyed one by one by separation rollers 8 and 9 to first resist roller 12 and first pressure roller 13. Furthermore, first resist roller 12 and first pressure roller 13 convey the sheet to second resist roller 14 and second pressure roller 15. Sheet 100 conveyed by second resist roller 14 and second pressure roller 15 is conveyed to photoreceptor drum 4 of image formation unit 2 and transfer roller 10.

Photoreceptor drum 4 and transfer roller 10 apply a voltage to transfer roller 10 from a high-voltage power supply, not shown, and transfer a developer image formed on a surface of photoreceptor drum 4 to a surface of sheet 100, and then convey sheet 100. Sheet 100, to which the image is transferred, is conveyed to fixing unit 28 and heated/pressed by fixing unit 28, whereby the image is fixed on sheet 100. Sheet 100 on which the image is now fixed is conveyed to be stacked on sheet load surface 29, where other sheets may be stacked.

Here, during a continuous image formation operation, photoreceptor drum 4 is always rotating. Then, the surface temperature of photoreceptor drum 4 rises due to the sliding of the surface with development roller 5 or charging roller 8 in image formation unit 2, or from the friction with cleaning blade 7. In addition, during the continuous image formation operation, fixing roller 19 in fixing unit 28 continues to be heated by a heater, not shown, to maintain a constant temperature. Consequently, the internal temperature of image formation apparatus 1 rises and the surface temperature of photoreceptor drum 4 rises.

In such a case, the fluidity of the toner, which is a developer, is reduced as the temperature rises, which causes the toner to coagulate. Consequently, a developer image (toner image) formed on the surface of photoreceptor drum 4 having a high surface temperature is not transferred to sheet 100, which may lead to a poor print quality.

Hence, in the first embodiment, in order to prevent degradation of the print quality, the temperature of photoreceptor drum 4 is accurately sensed and the image formation processing is performed according to the sensed temperature.

Figure 4:
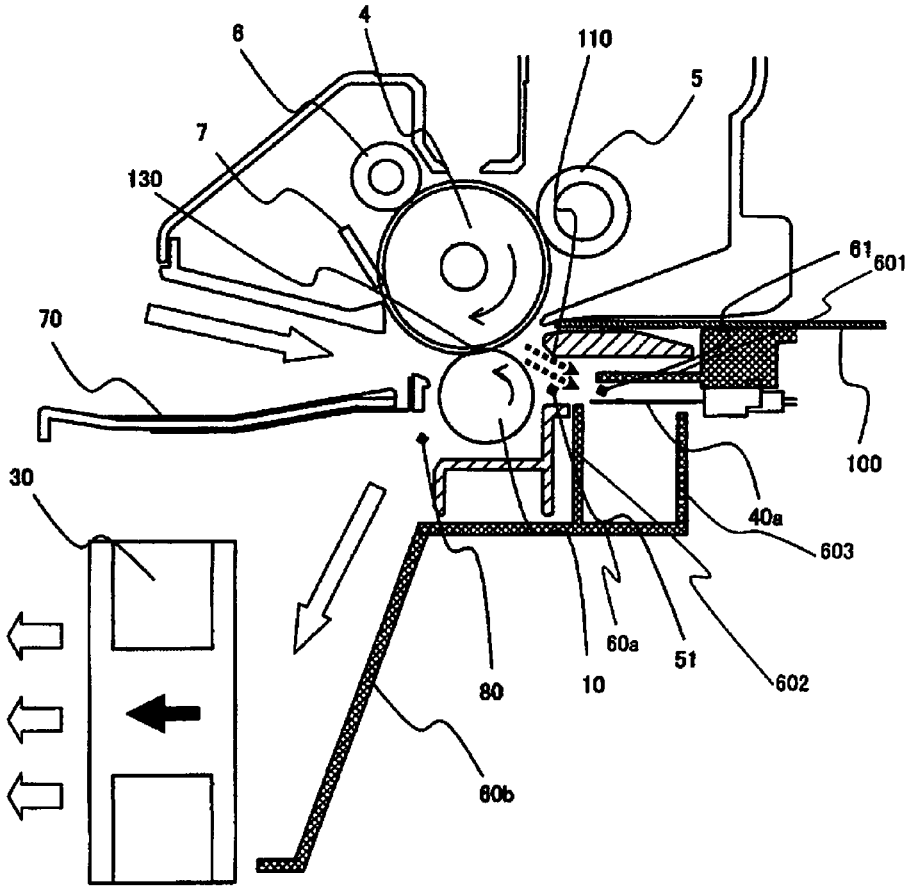
FIG. 4 is an illustration illustrating an operation of the formation of airflow by a blower and that of temperature sensing by the temperature sensor in the image formation apparatus according to the first embodiment.

FIG. 4 is an illustration of an operation of the formation of airflow by blower 30 and that of temperature sensing by temperature sensor 40, in image formation apparatus 1 according to the first embodiment.

During continuous image formation operations, for example, under the control of controller 200, a fan of blower 30 is driven. When the fan of blower 30 is driven, blower 30 generates an airflow in which air in image formation apparatus 1 flows to blower 30 in the direction of the outline arrow in FIG. 4, and the air is exhausted to the outside.

Thus in image formation apparatus 1 according to the first embodiment, air on the downstream side of the sheet conveyance direction, with nip part 130 between photoreceptor drum 4 and transfer roller 10 as a boundary, flows to blower 30.

In addition, blower 30 by exhausting to the outside the air on the downstream side in the sheet conveyance direction with nip part 130 between photoreceptor drum 4 and transfer roller 10 as a boundary, air on the upstream side with nip part 130 as a boundary also flows slightly to blower 30. Specifically, air in sheet conveyance direction upstream-side space 140 in the neighborhood of photoreceptor drum 4 flows to downstream-side air duct 80 via transfer frame opening 51.

When the internal temperature of image formation apparatus 1 rises, photoreceptor drum ambient temperature 110 around photoreceptor drum 4 also rises together with the surface temperature of photoreceptor drum 4. As described above, the airflow (the outline arrow of FIG. 4) formed on the downstream side with nip part 130 as a boundary cools the photoreceptor drum 4, making it possible to prevent an elevation of the surface temperature of photoreceptor drum 4.

In addition, the air in sheet conveyance direction upstream-side space 140 slightly moves to downstream-side air duct 80 via a vent passage on the upstream side. Thus, the air influenced by photoreceptor drum ambient temperature 110 moves to transfer frame opening 51 and thermosensitive opening 61, and thermosensitive part 40*a* of temperature sensor 40 can sense photoreceptor drum ambient temperature 110 through thermosensitive opening 61.

Here, thermosensitive part 40*a* of temperature sensor 40 is surrounded by partition member 61 of sheet conveyance direction upstream-side guide frame 60 and partition members 602 and 602 of sheet conveyance direction upstream-side frame 60*a*. In addition, nip part 130 is formed between photoreceptor drum. 4 and transfer roller 10. Then, the air on the downstream side in the sheet conveyance direction may flow into the upstream side in the sheet conveyance direction by countercurrent or convection current occurred in image formation apparatus 1. However, since nip part 130 is formed between photoreceptor drum 4 and transfer roller 10, and thermosensitive part 40*a* of temperature sensor 40 is surrounded by partition members 601, 602, and 603, inflow of the airflow on the downstream side in the sheet conveyance direction can be blocked, and thermosensitive part 40*a* can sense photoreceptor drum ambient temperature 110 around photoreceptor drum 4 on the upstream side in the sheet conveyance direction.

A sensed temperature by thermosensitive part 40*a* of temperature sensor 40 is converted into an electric signal, and the electric signal is transmitted to controller 200 as the sensed temperature information.

Figure 5:
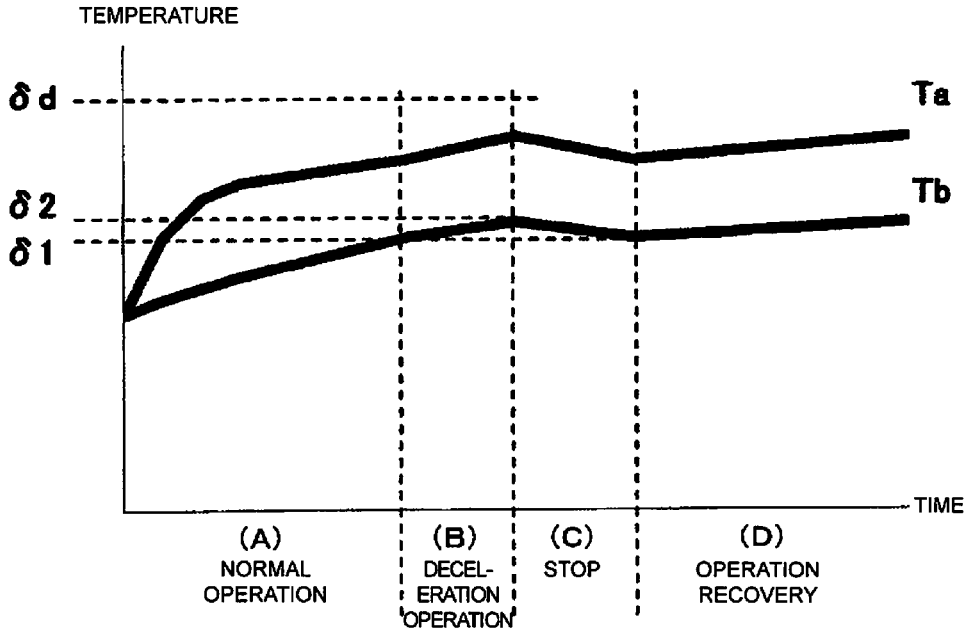
FIG. 5 is an illustration illustrating the drive and control of the photoreceptor drum, by using a sensed temperature of the temperature sensor according to the first embodiment.

FIG. 5 is an illustration illustrating the drive and control of photoreceptor drum 4 using a sensed temperature of temperature sensor 40 according to the first embodiment.

In FIG. 5, the vertical axis represents temperature and the horizontal axis represents time. In addition, Ta represents the surface temperature of photoreceptor drum 4 and Tb represents the sensed temperature (photoreceptor drum ambient temperature) sensed by temperature sensor 40.

In FIG. 5(A), when image formation apparatus 1 receives a print order, controller 200 instructs photoreceptor drum driver 45 to start driving photoreceptor drum 4. Then, the surface temperature Ta of photoreceptor drum 4 rises due to the sliding of development roller 5 or charging roller 6 which abuts against the surface of photoreceptor drum 4 and the friction generated with cleaning blade 7. In addition, since photoreceptor drum ambient temperature 110 also rises as the surface temperature of photoreceptor drum 4 rises, as illustrated in FIG. 5(A), it is seen that the sensed temperature Tb of temperature sensor 40 also rises.

In addition, as illustrated in FIG. 5(A), while image formation apparatus 1 continuously receives print orders, photoreceptor drum 4 is always driven. Thus, surface temperature Ta of photoreceptor drum 4 continues to rise. In contrast to this, it is also seen that sensed temperature Tb by temperature sensor 40 also continues to rise while maintaining a constant relation with surface temperature Ta of photoreceptor drum 4.

Here, controller 200 compares sensed temperature Tb of temperature sensor 40 with deceleration operation temperature threshold δ1. Then, when sensed temperature Tb of temperature sensor 40 exceeds deceleration operation temperature threshold δ1, controller 200 performs deceleration operation control on photoreceptor drum driver 45 to decelerate a rotational speed of photoreceptor drum 4. Particularly, controller 200 achieves control by controlling a drive current to photoreceptor drum driver 45 such as a motor by means of a servo and the like, and controlling the number of rotations. For example, controller 200 decelerates photoreceptor drum 4 by about 15% (see FIG. 5(B)).

Consequently, a temperature-elevation gradient of surface temperature Ta of photoreceptor drum 4 becomes gradual. In addition, the temperature-elevation gradient of sensed temperature Tb of temperature sensor 40 also becomes gradual while maintaining a constant relationship with surface temperature Ta of photoreceptor drum 4.

While continuously receiving print orders, controller 200 compares sensed temperatures of temperature sensor 40 with stop temperature threshold δ2. Then, when the sensed temperature of temperature sensor 40 exceeds stop temperature threshold δ2, controller 200 controls drive stop of photoreceptor drum. 4 on photoreceptor drum driver 45 (see FIG. 5(C)).

Consequently, surface temperature Ta of photoreceptor drum 4 falls. In addition, sensed temperature Tb of temperature sensor 40 also falls while maintaining a constant relationship with surface temperature Ta of photoreceptor drum 4.

Then, controller 200 compares sensed temperature Tb of temperature sensor 40 with deceleration operation temperature threshold δ1. When sensed temperature Tb of temperature sensor 40 falls below deceleration operation temperature threshold δ1, controller 200 performs deceleration operation control on photoreceptor drum driver 45 to drive photoreceptor drum. 4 (see FIG. 5(D)). Specifically, controller 200 recovers drive of photoreceptor drum 4.

Here, δd is a photoreceptor drum dangerous temperature at which the poor print quality based on the deterioration of developer characteristics described above occurs. Controller 200 is required to control so that surface temperature Ta of photoreceptor drum 4 does not reach photoreceptor drum dangerous temperature δd.

In contrast to this, as described above, sensed temperature Tb of temperature sensor 40 varies while maintaining a constant relationship with surface temperature Ta of photoreceptor drum 4. Thus, based on a relationship of surface temperature Ta of photoreceptor drum 4 and sensed temperature Tb of temperature sensor 40, stop temperature threshold δ2 and deceleration operation temperature threshold δ1 are set so that the surface temperature Ta of photoreceptor drum 4 does not reach photoreceptor drum dangerous δd.

Note that while in the example of FIG. 5, the two thresholds of deceleration operation temperature threshold δ1 and stop temperature threshold δ2 are illustrated as an example of thresholds to be compared with sensed temperature Tb of temperature sensor 40, the number of thresholds is not specifically limited. The threshold may be one or more than three.

In addition, a case is also illustrated by an example that when photoreceptor drum 4 is recovered from a stopped state of FIG. 5(D) to an operation state of FIG. 5(C), controller 200 uses the same threshold as the deceleration operation threshold δ1 which is used for the transition from a state in FIG. 5(A) to a state in FIG. 5(B). However, in order to avoid a repetition of state transitions according to the elevation gradient of sensed temperature Tb, a threshold (threshold related to operation recovery) whose value is smaller than deceleration operation temperature threshold δ1 may be used.

Furthermore, after the operation is recovered, controller 200 may also control the deceleration operation so that the rotational speed of photoreceptor drum 4 is slower. For example, if controller 200 decelerates the rotational speed of normal operation by about 15% in the transition from the normal operation of FIG. 5(A) to the deceleration operation of FIG. 5(B), for example, controller 200 may decelerate the rotational speed of the normal operation by about 20% when the operation is recovered.

(A-3) Effect of the First Embodiment

As described above, according to the first embodiment, by the temperature sensor 40 being provided on the upstream side in the sheet conveyance direction of photoreceptor drum 4 and transfer roller 10, and the fan of blower 30 moving the air on the downstream side in the sheet conveyance direction with nip part 130 between photoreceptor drum 4 and transfer roller 10 as a boundary, not only photoreceptor drum 4 can be cooled, but also temperature sensor 40 can sense photoreceptor drum ambient temperature 110 on the upstream side in the sheet conveyance direction. Hence, the effect of being able to accurately sense the surface temperature of photoreceptor drum 4 can be obtained.

In addition, according to the first embodiment, the effect of being able to achieve further acceleration of a print speed can be obtained through accurate sensing of the surface temperature of photoreceptor drum 4.

(B) Second Embodiment

In the following, a second embodiment of an image formation apparatus of the invention is described in detail with reference to the drawings.

The second embodiment is described by illustrating a case by example in which the invention is applied to an image formation apparatus which adopts an electrophotographic scheme and supports double-side printing. While the image formation apparatus of the second embodiment in the case of a monochrome printer is illustrated by an example, it can be widely applied to a variety of image formation apparatuses such as a color printer, a copying machine, or facsimile device and the like.

(B-1) Configuration of the Second Embodiment

Figure 6:
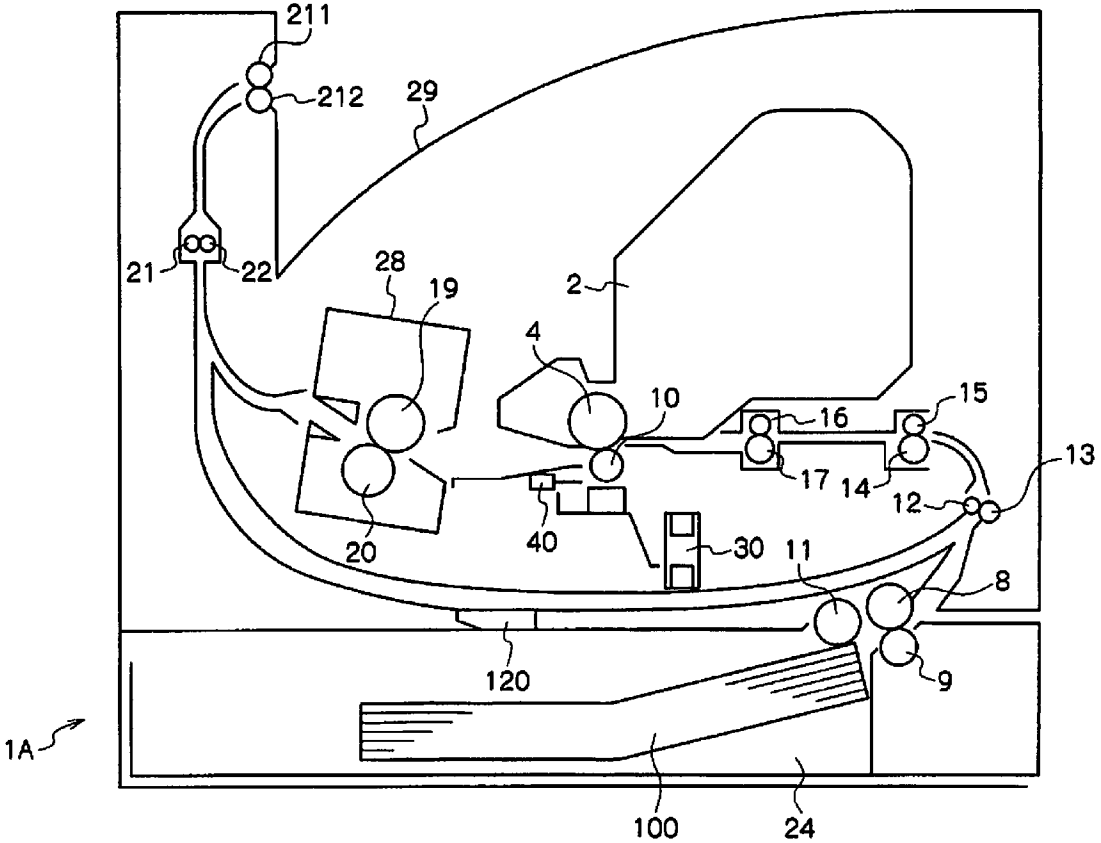
FIG. 6 is a perspective cross sectional view illustrating an internal configuration of the housing interior of an image formation apparatus according to a second embodiment.

FIG. 6 is a perspective sectional view illustrating the internal configuration of the housing interior of image formation apparatus 1A according to the second embodiment. In FIG. 6, components which are the same or correspond to image formation apparatus 1 of the first embodiment are assigned the same symbols as in FIG. 1 according to the first embodiment.

In FIG. 6, image formation apparatus 1A according to the second embodiment has image formation unit 2, sheet cassette 24, photoreceptor drum 4, transfer roller 10, paper feed roller 11, separation rollers 8 and 9, first resist roller 12, first pressure roller 13, second resist roller 14, second pressure roller 15, conveyance rollers 16 and 17, fixing unit 19, fixing backup roller 20, fixing unit 28, ejection rollers 21 and 22, ejection rollers 211 and 212, blower 30, temperature sensor 40, and double-side conveyor 120.

In the case of double-side printing, ejection rollers 21 and 22 are configured to convey a sheet of paper, which is conveyed from fixing unit 28, to double-side conveyor 120. Note that in the case of single-side printing, similar to the first embodiment, ejection rollers 21 and 22 convey a sheet conveyed from fixing unit 28, to ejection rollers 211 and 212.

When double-side printing is performed, double-side conveyor 120 is configured to convey to first resist roller 12 and first pressure roller 13 a sheet on which an image is fixed by fixing unit 28 and which is conveyed from ejection rollers 21 and 22.

Figure 7:
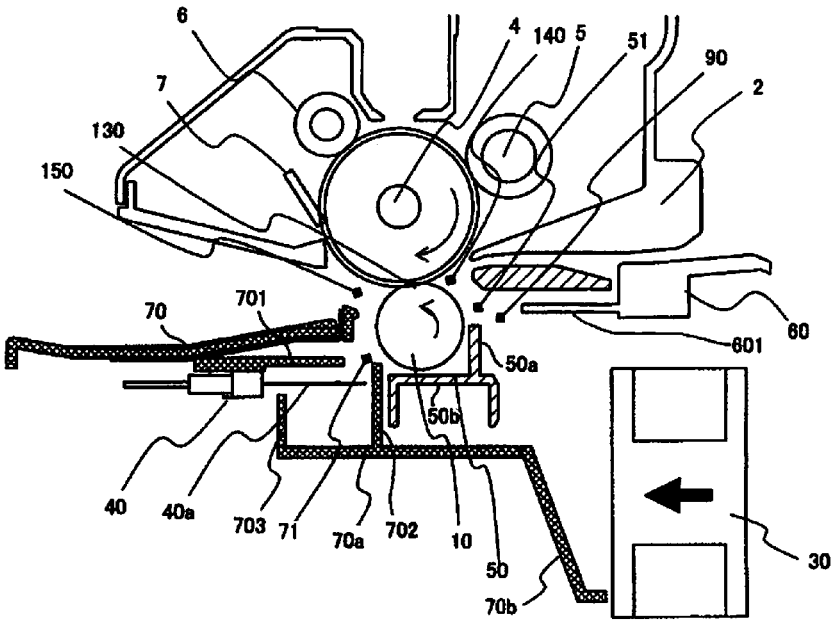
FIG. 7 is a configuration diagram illustrating a detailed configuration of a periphery of a temperature sensor in the image formation apparatus according to the second embodiment.

FIG. 7 is a configuration diagram illustrating a detailed configuration of a periphery of temperature sensor 40 in image formation apparatus 1A according to the second embodiment.

In FIG. 7, a configuration of the surroundings of temperature sensor 40 of image formation apparatus 1A has photoreceptor drum 4, development roller 5, charging roller 6, cleaning blade 7, transfer roller 10, blower 30, temperature sensor 40, transfer frame 50, sheet conveyance direction upstream-side guide frame 60, sheet conveyance direction downstream-side guide frame 70, sheet conveyance direction downstream-side frame 70*a*, and sheet conveyance direction upstream-side guide ventilation wall 70*b*.

Charging roller 6, development roller 5, and cleaning blade 7 are provided in image formation unit 2, similar to the first embodiment.

In FIG. 6, blower 30 is provided on the upstream side of the sheet conveyance direction with nip part 130 between photoreceptor drum 4 and transfer roller 10 as a boundary. Blower 30 is configured to blow from the upstream side in the sheet conveyance direction to photoreceptor drum 4. Specifically, when a fan is being driven, blower 30 sends air from the upstream side in the sheet conveyance direction to photoreceptor drum 4.

Here, in the case of double-side printing, sheet 10 after the image is fixed is fed to image formation unit 2 again. Thus, not only the surface temperature of photoreceptor drum 4 but also the sheet temperature is relatively high. In the second embodiment, blower 30 sends air to photoreceptor drum 4 and sheet 100, thereby being able to cool photoreceptor drum 4 and sheet 100.

Similar to the first embodiment, sheet conveyance direction upstream-side guide frame 60 is configured to guide a sheet conveyed from conveyance rollers 16 and 17 (see FIG. 6). Sheet conveyance direction upstream-side guide frame 60 has a flat upper surface to guide sheets to be conveyed. Furthermore, partition member 601 is arranged along a horizontal direction below sheet conveyance direction upstream-side guide frame 60.

Transfer frame 50 is configured to retain transfer roller 10 and has partition member 50*a* in a vertical direction.

Upstream-side air duct 90 is formed by partition member 50*a* of transfer frame 50 and partition member 601 of sheet conveyance direction upstream-side guide frame 60. Consequently, airflow sent from blower 30 flows from upstream-side air duct 90 toward photoreceptor drum 4.

Sheet conveyance direction upstream-side guide ventilation wall 70 is provided at an angle to a direction near blower 30 from an end of sheet conveyance direction upstream-side frame 701, and guides the airflow sent from blower 30 to upstream-side air duct 90.

As similar to the first embodiment, sheet conveyance direction downstream-side guide frame 70 is configured to convey and guide a sheet ejected from photoreceptor drum 4 and transfer roller 10. In addition, partition member 701 extending along an almost horizontal direction is provided below sheet conveyance direction downstream-side guide frame 70.

Temperature sensor 40 is provided on the downstream side in the sheet conveyance direction with nip part 130 between photoreceptor drum 4 and transfer roller 10 as a boundary. For example, as illustrated in FIG. 7, temperature sensor 40 is retained in partition member 701 of sheet conveyance direction downstream-side guide frame 70.

In sheet conveyance direction downstream-side frame 70*a*, partition members 702 and 703 are provided in a vertical direction to a bottom which is arranged along the horizontal direction.

Here, a plate and the like to be arranged along a longitudinal direction of photoreceptor drum 4 can be used for partition members 701, 702, and 703, which are provided to surround temperature sensor 40 to block an inflow of airflow, except for thermosensitive opening 71 to be described below. In addition, a tip of partition member 701 arranged along the horizontal direction is out of contact with a tip of partition member 702 arranged in a vertical direction. Thermosensitive opening 71 is formed so that thermosensitive part 40*a* of temperature sensor 40 can sense an ambient temperature of photoreceptor drum 4.

Note that in order to make it possible to block from between transfer roller 10 and transfer frame 50 the inflow of airflow from the upstream side in the sheet conveyance direction, partition member 702 is extended to a position higher than a position of a retainer 50*b* of transfer frame 50 in the horizontal direction.

In order to sense the ambient temperature of photoreceptor drum 4, thermosensitive part 40*a* of temperature sensor 40 is provided in a position adjacent to thermosensitive opening 71 to which the sheet conveyance direction downstream-side airflow flows. Specifically, through thermosensitive opening 71, thermosensitive part 40*a* of temperature sensor 40 senses the ambient temperature of photosensitive drum 4 on the downstream side of sheet conveyance direction.

(B-2) Operation of the Second Embodiment

In the following, an operation in image formation apparatus 1A according to the second embodiment is described.

Since an image formation operation in the case in which image formation apparatus 1A according to the second embodiment performs single-side printing is similar to the first embodiment, a detailed description is omitted here.

When double-side printing is performed in image formation apparatus 1A, sheet 100 is heated and pressed by fixing unit 28 and an image is fixed on one side thereof. Then, sheet 100 is ejected from fixing unit 28, and once conveyed to ejection rollers 21 and 22. Then, ejection rollers 21 and 22 rotate backward and sheet 100 is conveyed to double-side conveyor 120.

Sheet 100 conveyed from double-side conveyor 120 is conveyed to first resist roller 12 and first pressure roller 13. Then, the sheet surface of sheet 100 is inverted, and with the sheet surface on which no image is fixed now being an upper surface, sheet 100 is conveyed to image formation unit 2. Consequently, an image is formed on the sheet surface on which no image is fixed.

Here, similar to the first embodiment, during a continuous image formation operation, the internal temperature of image forming apparatus 1 rises and the surface temperature of photoreceptor drum 4 rises. In addition, when double-side printing is performed, a sheet on one side of which an image is fixed is fed again to image formation unit 2. Thus, the surface temperature of sheet 100 is high. When an image is transferred by photoreceptor drum 4 and transfer roller 10, the surface temperature of sheet 100 is transmitted to photoreceptor drum 4, and the surface temperature of photoreceptor drum 4 is increased.

As a result, the fluidity of the toner, which is a developer, is reduced as the temperature rises which causes the toner to coagulate. Consequently, a developer image (toner image) formed on the surface of photoreceptor drum 4 with a high surface temperature is not transferred correctly to sheet 100, which may cause the poor print quality.

Hence, in the second embodiment, in order to prevent a degradation of the print quality, the temperature of photoreceptor drum 4 is accurately sensed and image formation processing is performed according to the sensed temperature.

Figure 8:
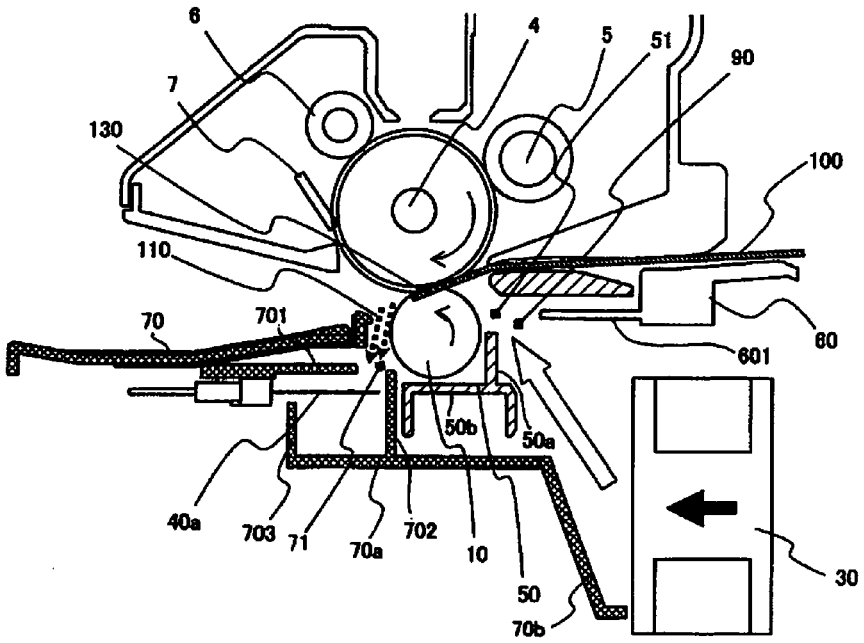
FIG. 8 is an illustration illustrating an operation of the formation of airflow by a blower and that of temperature sensing by the temperature sensor in the image formation apparatus according to the second embodiment.

FIG. 8 is an illustration showing an operation of the formation of airflow by blower 30 and the temperature sensing operation by temperature sensor 40 in image formation apparatus 1A according to the second embodiment.

For example, during a continuous image formation operation or double-side printing, a fan of blower 30 is driven under the control of controller 200. Air sent from the fan of blower 30 to the direction of the outline arrow in FIG. 8 flows along sheet conveyance direction upstream-side guide ventilation wall 70*b*, and the air flows toward photoreceptor drum 4 from upstream-side air duct 90.

Specifically, although the surface temperature of photoreceptor drum 4 is increased and the photoreceptor drum ambient temperature is increased, the temperature of the air sent by blower 30 is lower than the photoreceptor drum ambient temperature. Thus, photoreceptor drum 4 with its surface temperature increased can be cooled. In addition, in the case of double-side printing, the temperature of sheet 100 can be cooled.

On the one hand, on sheet conveyance direction downstream side 150 with nip part 130 between photoreceptor drum 4 and transfer roller 10 as a boundary, photoreceptor drum ambient temperature 110 around photoreceptor drum 4 is increased together with the surface temperature of photoreceptor drum 4.

With thermosensitive opening 71 being open, photoreceptor drum ambient temperature 110 is sensed by thermosensitive part 40*a* of temperature sensor 4.

Here, thermosensitive part 40*a* of temperature sensor 40 is surrounded by partition members 701, 702 and 703. In addition, nip part 130 is formed between photoreceptor drum 4 and transfer roller 10. Then, the air on the upstream side in the sheet conveyance direction may flow into the downstream side in the sheet conveyance direction by countercurrent or convection current in image formation apparatus 1A. However, since nip part 130 is formed between photoreceptor drum 4 and transfer roller 10, and thermosensitive part 40*a* of temperature sensor 40 is surrounded by partition members 701, 702, and 703, any inflow of the airflow on the upstream side in the sheet conveyance direction can be blocked. Thermosensitive part 40*a* can then sense the temperature on the downstream side in the sheet conveyance direction, which is influenced by photoreceptor drum ambient temperature 110.

The sensed temperature by thermosensitive part 40*a* of temperature sensor 40 is converted into an electric signal, and the electric signal is transmitted to controller 200 as sensed temperature information. Then, similar to the first embodiment, controller 200 performs the drive processing of photoreceptor drum 4.

(B-3) Effect of the Second Embodiment

As described above, according to the second embodiment, by temperature sensor 40 being provided on the downstream side in the sheet conveyance direction of photoreceptor drum 4 and transfer roller 10, and by the fan of blower 30 sending air to photoreceptor drum 4 with nip part 130 between photoreceptor drum 4 and transfer roller 10 as a boundary, not only can photoreceptor drum 4 and sheet 100 be cooled, but also temperature sensor 40 can sense a photoreceptor drum ambient temperature on the downstream side in the sheet conveyance direction. Hence, even in a double-side conveyance operation, the effect of being able to accurately sense the surface temperature of photoreceptor drum 4 can be obtained.

In addition, according to the second embodiment, the effect of being able to achieve further acceleration of the print speed can be obtained by the accurate sensing of the surface temperature of photoreceptor drum 4.

(C) Other Embodiments

Although different variations are described in the above-mentioned embodiments, the invention can also be applied to other embodiments to be described below.

(C-1) In the above-mentioned embodiments, the case in which a temperature sensor uses a non-contact type thermistor and the like is illustrated by an example. However, a contact-type temperature sensor, such as a contact-type thermistor and the like, may be used for a photoreceptor drum as a developer image carrier.

(C-2) In the above-mentioned embodiments, partition members 601, 602 and 603 (or partition members 701, 702, and 703) are configured to have thermosensitive opening 51 (or thermosensitive opening 71) for thermosensitive part 40*a* of temperature sensor 40 to sense photoreceptor drum ambient temperature 110. This thermosensitive opening 61 or 71 may be formed as partition members 601 and 602 (or partition members 701 and 702) become contactless, or, for example, may be a hole through which thermosensitive part 40*a* can sense a temperature.

(C-3) In the above-mentioned embodiments, although the case in which there is one temperature sensor 40 is illustrated by an example, temperature sensors 40 may be provided in a longitudinal direction of photoreceptor drum 4. Furthermore, if temperature sensors are provided, a controller may perform the drive control of photoreceptor drum 4 by using a value obtained by averaging the sensed temperatures from the temperature sensors.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising:

a developer image carrier configured to carry a developer image;

a transfer unit provided in contact with the developer image carrier, and configured to transfer the developer image onto a medium which is conveyed along a medium conveyance path which passes through a contact between the developer image carrier and the transfer unit;

a blower provided on one of an upstream side and a downstream side, in a medium conveyance direction, of the contact, and configured to flow air to cool the surface temperature of the developer image carrier;

a temperature sensor provided on the other of the upstream and downstream sides, in the medium conveyance direction, of the contact, and configured to sense an ambient temperature around the developer image carrier; and a guide configured, when the blower operates, to guide air from the contact toward the downstream side in the medium conveyance direction and to guide air from the contact toward the upstream side in the medium conveyance direction.

2. The image formation apparatus according to claim 1, wherein the blower is provided on the downstream side in the sheet conveyance direction of the contact, and is configured to take in air from an upstream side in the medium conveyance direction of the blower and exhaust the air to a downstream side in the medium conveyance direction of the blower, and the temperature sensor is provided on the upstream side in the medium conveyance direction of the contact, and is configured to sense the ambient temperature around the developer image carrier on the upstream side in the medium conveyance direction of the contact.

3. The image formation apparatus according to claim 1, wherein the blower is provided on the upstream side in the medium conveyance direction of the contact, and is configured to send air toward the developer image carrier which is provided on a downstream side in the medium conveyance direction of the blower, and the temperature sensor is provided on the downstream side in the medium conveyance direction of the contact, and is configured to sense the ambient temperature around the developer image carrier on the downstream side in the medium conveyance direction of the contact.

4. The image formation apparatus according to claim 1, comprising a block part provided to surround the temperature sensor and including an opening through which the temperature sensor is opposed to the contact to thereby sense the ambient temperature around the developer image carrier.

5. The image formation apparatus according to claim 1, comprising a control unit configured to perform a drive control of the developer image carrier on the basis of a sensed temperature sensed by the temperature sensor.

6. The image formation apparatus according to claim 1, wherein the temperature sensor is provided out of contact with the developer image carrier.

7. The image formation apparatus according to claim 1, wherein the developer image carrier is replaceable.

8. The image formation apparatus according to claim 1, wherein the blower is a fan.

9. The image formation apparatus according to claim 1, wherein the blower is provided below the medium conveyance path.

10. The image formation apparatus according to claim 9, wherein the developer image carrier is provided above the medium conveyance path, and the blower is configured to generate air blowing toward the developer image carrier by taking in air from near the developer image carrier provided above the medium conveyance path.

11. The image formation apparatus according to claim 9, wherein the developer image carrier is provided above the medium conveyance path, while the transfer unit is provided below the medium conveyance path, and the blower is configured to generate air blowing toward the developer image carrier provided above the medium conveyance path, while passing near the transfer unit provided below the medium conveyance path.

12. The image formation apparatus according to claim 1, wherein the guide includes a first guide portion provided between the contact and the temperature sensor and forming a first air passage from the contact toward the temperature sensor.

13. The image formation apparatus according to claim 12, wherein the first guide portion includes a block part, wherein the block part substantially surrounds the temperature sensor and includes an opening through which the temperature sensor is opposed to the contact to thereby forming the first air passage.

14. The image formation apparatus according to claim 1, wherein the guide includes a second guide portion provided between the contact and the blower and forming a second air passage from the contact toward the blower.

15. The image formation apparatus according to claim 14, wherein the second guide portion comprises:

a second medium guide member provided on the one of the upstream and downstream sides on which the blower is provided, the second medium guide member extending along the medium conveyance path to guide the medium; and a second air guide member facing the second medium guide member and extending from an area in vicinity of the contact toward the blower, such that the second medium guide member and the second air guide member define the second air passage.

16. The image formation apparatus according to claim 1, wherein the guide comprises a transfer frame retaining a transfer unit, and the transfer frame includes: a medium guide portion provided between the medium conveyance path and the temperature sensor and extending along the medium conveyance path and configured to guide the medium being conveyed along the medium conveyance path; a retaining portion retaining the transfer unit; and a transfer frame opening provided between the medium guide portion and the retaining portion and forming a part of a first air passage extending from an area in vicinity of the contact toward the temperature sensor.

17. The image formation apparatus according to claim 16, wherein the guide comprises a first medium guide frame provided on the other of the upstream and downstream sides on which the temperature sensor is provided and configured to guide the medium being conveyed along the medium conveyance path, the first medium guide frame includes: a first partition portion extending below and along the medium guide portion of the transfer frame; a second partition portion provided between the retaining portion of the transfer frame and the temperature sensor; and a thermosensitive opening provided between the first partition portion and the second partition portion and forming a part of the first air passage.

18. The image formation apparatus according to claim 17, wherein the guide comprises a second medium guide frame provided on the one of the upstream and downstream sides on which the blower is provided and configured to guide the medium being conveyed along the medium conveyance path, the first medium guide frame further includes an air guide wall facing the second medium guide member and extending from an area in vicinity of the contact toward the blower, such that the second medium guide frame and the air guide wall define a second air passage extending from the area in vicinity of the contact toward the blower.

19. The image formation apparatus according to claim 1, wherein the blower is provided below the sheet conveyance path such that no portion of the blower protrudes above the sheet conveyance path.

20. An image formation apparatus, comprising:

a developer image carrier configured to carry a developer image;

a transfer unit provided in contact with the developer image carrier, and configured to transfer the developer image onto a print sheet which is conveyed along a sheet conveyance path which passes through a contact between the developer image carrier and the transfer unit;

a blower provided on one of an upstream side and a downstream side, in a sheet conveyance direction, of the contact, and configured to flow air to cool the surface temperature of the developer image carrier; and a temperature sensor provided on the other of the upstream and downstream sides, in the sheet conveyance direction, of the contact, and configured to sense an ambient temperature around the developer image carrier, wherein the blower is provided below the sheet conveyance path such that no portion of the blower protrudes above the sheet conveyance path.

* * * * *